United States Patent [19]

Parr

[11] Patent Number: 4,899,848

[45] Date of Patent: Feb. 13, 1990

[54] GUARD FOR UPPER END OF LADDER SIDE RAIL

[76] Inventor: John W. Parr, 6121 Harvey St., Apt. #16, Panama City, Fla. 32404

[21] Appl. No.: 345,024

[22] Filed: Apr. 28, 1989

[51] Int. Cl.[4] ..... E06C 7/48

[52] U.S. Cl. ..... 182/108; 182/214; 248/210

[58] Field of Search ..... 182/107, 108, 109, 110, 182/111, 194, 214

[56] References Cited

U.S. PATENT DOCUMENTS

| | | | |
|---|---|---|---|
| 1,558,479 | 10/1925 | Hearn | 182/108 |
| 2,904,128 | 9/1959 | Boham | 182/108 |
| 2,925,877 | 2/1960 | Wright | 182/108 |
| 3,062,319 | 11/1962 | Wright | 182/108 |
| 3,662,856 | 5/1972 | D'Amico | 182/108 |
| 3,993,163 | 11/1976 | Barrett | 182/108 |
| 4,683,980 | 8/1987 | Vayko | 182/108 |
| 4,754,842 | 7/1988 | Southern | 182/111 |
| 4,771,862 | 9/1988 | Garland | 182/108 |

FOREIGN PATENT DOCUMENTS

| | | | |
|---|---|---|---|
| 1176611 | 10/1984 | Canada | 182/108 |
| 6177 | of 1889 | United Kingdom | 182/108 |

*Primary Examiner*—Reinaldo P. Machado
*Attorney, Agent, or Firm*—Anthony F. Cuoco

[57] ABSTRACT

A guard for the upper end of a ladder side rail telescopes over said upper end to prevent the surface against which the ladder rests from being marred. The guard includes a rigid body and a resilient pad removably affixed to the body. The resilient pad engages the surface for preventing said marring. The resilient pad is replaceable as it loses its resiliency or otherwise wears out so that the entire guard does not have to be replaced, whereby the effectivity, usefulness and cost effectiveness of the guard is enhanced.

7 Claims, 1 Drawing Sheet

GUARD FOR UPPER END OF LADDER SIDE RAIL

BACKGROUND OF THE INVENTION

This invention relates to a guard for the upper end of a ladder side rail and, particularly, to a guard mounted to the upper end of a ladder side rail for supporting the ladder against a vertical support surface while minimizing damage to such surface.

Ladders are widely used for working above ground levels by painters, decorators, and the like. The ladders include a pair of side rails disposed in parallel spaced relation to each other and interconnected by longitudinally spaced rungs which extend between and are affixed to the side rails. The upper ends of the side rails project upwardly from the uppermost rung a short distance for engaging a vertical surface such as a wall, the side of a building, and the like. The bottom ends of the side rails are constructed to rest on the floor or the ground, as the case may be, at an appropriately inclined position against the vertical surface. Various prior art devices have been suggested for attachment to the upper ends of the side rails for the purposes of protecting the vertical surface from damage as a result of engagement by the rigid side rails with said surface.

The present inventor is aware of several pertinent patents found in Class 182, Subclass 108. These patents include U.S. Pat. No. 2,904,128 issued to Bohan, et al on Sept. 15, 1959 which relates to a hood-like arrangement which fits over the ends of the side rails and is secured thereon via a strap-like arrangement engaging the uppermost rung of the ladder; U.S. Pat. No. 3,062,319 issued to Wright on Nov. 6, 1962 which relates to a cap for a ladder rail having a non-slip surface including a transverse series of vertically formed spaced ribs for increasing the resistance to slippage when the ribs are resting against a surface upon which the ladder leans; U.S. Pat. No. 3,662,856 issued to D'Amico on May 16, 1972 which relates to a flexible foam body member including elastic means for easily assembling and removing the member from the ends of the side rails; U.S. Pat. No. 3,993,163 issued to Barrett on Nov. 23, 1976 which relates to a ladder sock which is fastened in place via a strap or the like to prevent the ends of the rails from marring any surface upon which the ladder may be leaning; and U.S. Pat. No. 4,771,862 issued to Garland on Sept. 20, 1988 which relates to a guard which is telescoped over the upper ends of the side rails to provide a protective mounting against a vertical structure against which the ladder leans. The ladder guard is formed as a single piece, cup-shaped member of a suitable soft rubber-like material and includes a body portion of a rectangular cross-section to fit over the upper ends of the side rails and a curved outer end wall. The ladder guard is provided with a serpentine cross-section to form an accordion or expandable structure permitting expanding and contracting of the narrow walls of the guard and to thereby provide a tight telescoping engagement with different sized ladder rails.

Although the prior art devices serve the purposes intended, none of these devices has the advantages of the present invention, to wit: providing a ladder side rail guard having a protective member in contact with a surface upon which the ladder leans, said member being replaceable so as to enhance the effectivity and utility of the guard to an extent greater than that of the prior art devices.

SUMMARY OF THE INVENTION

This invention contemplates a guard for the upper end of a ladder side rail which telescopes over said upper end to prevent the surface against which the ladder rests from being marred. The guard is of a rigid material and is hollow and substantially oblong and angles inwardly at its upper ends so as to rest on a vertical surface at an appropriate angle in accordance with the angle of incline of the ladder against said surface. At least one end of the guard carries a resilient pad affixed thereto via a loop and pile arrangement. In such an arrangement the pad may have the pile member of the loop and pile arrangement cemented or otherwise attached thereto and the one end of the guard may have the loop member cemented or otherwise attached thereto so that the pad and the one side of the guard are removably affixed to each other when the loop and pile members are engaged. The pad is thus replaceable as it wears out or loses its resiliency, or otherwise becomes ineffective for use. This is significant because under the circumstances described the entire guard does not have to be replaced as would otherwise be the case.

DETAILED DESCRIPTION OF THE INVENTION

Figure 1:
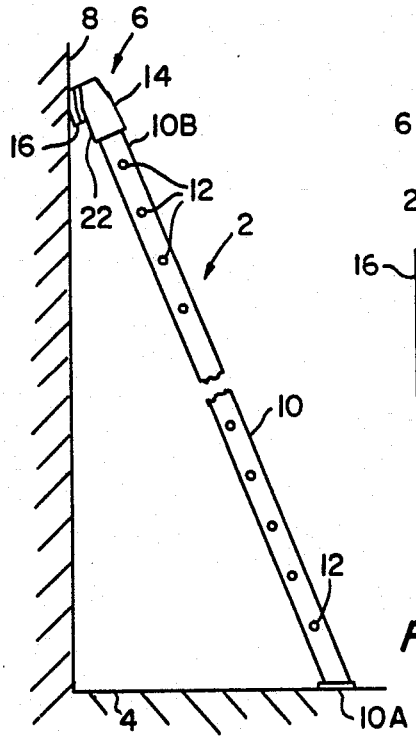
FIG. 1 is a diagrammatic representation showing a ladder supported on a horizontal surface and having a guard on the upper end of a side rail in accordance with the invention.

Referring particularly to FIG. 1, a typical ladder 2 is shown in a raised, used position with the lower end thereof resting on a substantially horizontal surface 4 and the upper end abutting a substantially vertical surface 8. Ladder 2 is of a conventional type having a pair of laterally spaced side rails such as 10 interconnected by a plurality of rungs 12. The side rails extend upwardly and downwardly beyond end rungs 12 to provide bottom and top ends 10A and 10B for engaging horizontal surface 4 and vertical surface 8, respectively.

As will be further explained, a guard 6 telescopes over top end 10B of rail 10. Guard 6 includes a rigid oblong hollow body member 14 and a resilient pad 16 removably affixed to member 14 for engaging vertical surface 8. Guard 6 is configured so as to telescope over top end 10B of rail 10 and to fit snugly thereon as will be hereinafter more fully described.

It will be readily understood that ladder 2 may be of any readily conventional and widely used form or construction, the present invention being directed not to the ladder but to guard 6. Accordingly, the ladder is not described in any further detail other than is necessary to fully explain and understand the present invention.

Figures 2, 3, 5:
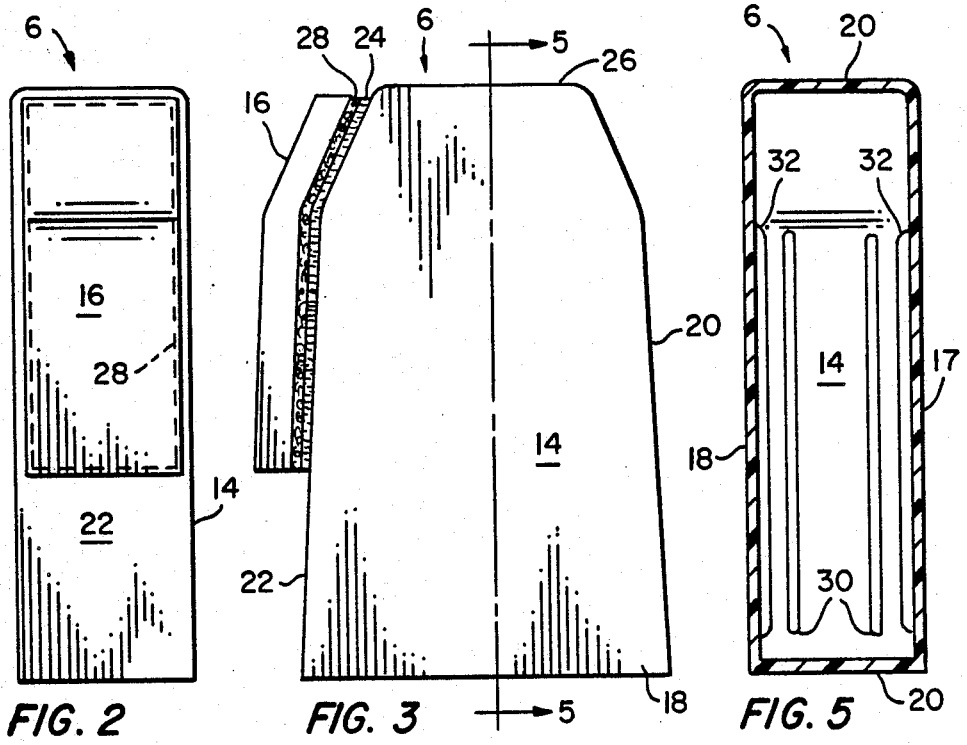
FIG. 2 is an end elevation view of the guard.
FIG. 3 is a side elevation view best showing the feature of the invention wherein a resilient pad removably engages an end of the guard in accordance with the invention.
FIG. 5 is a sectional view taken along line 5—5 in FIG. 3 and further showing the rib arrangement referred to in FIG. 4.
Figure 4:
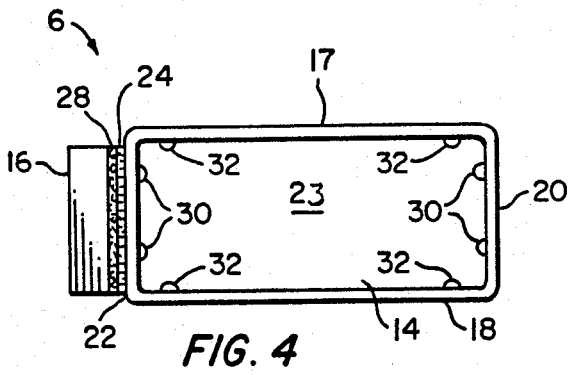
FIG. 4 is a bottom view showing the internal structure of the guard, and particularly showing a rib arrangement extending therealong for purposes to be described.

With reference now to FIGS. 2, 3 and 4, guard body 14 has a rectangular cross-section and includes a pair of sides 17 and 18, a pair of ends 20 and 22, an open bottom 23, and a closed top 26. Ends 20 and 22 taper inwardly from the bottom of the guard to the top so that open bottom 23 is wider than top 26 to facilitate telescoping of the guard over the rail end. Ends 20 and 22 angle inwardly near the tops thereof for purposes to be hereinafter explained.

One of the guard ends such as 22 carries resilient pad 16. Resilient pad 16 is affixed to the guard end via, for example, a loop and pile arrangement of the type well known in the art. Such an arrangement employs fabric strips made, for example, from a material manufactured under the trademark "Velcro" by American Velcro, Inc. of Manchester, NH. Thus, a loop strip 24 is affixed to guard end 22 as by cementing or the like so as to extend from below the center of said end to near top 26 of body 14, and to follow the angle of end 22 as particularly shown in FIG. 3. Pad 16, which may be of a soft resilient natural or synthetic rubber-like material, has a pile strip 28 likewise affixed on one side thereof as by cementing or the like. The length of pad 16 and pile strip 28 corresponds to the length of loop strip 24. Resilient pad 16 is removably affixed to guard end 22 by the engagement of loop strip 24 and pile strip 28 as will now be understood. Other means for removably affixing resilient pad 16 to guard end 22 are within the scope of the invention as will now be appreciated.

With reference again to FIG. 1, with pad 16 affixed to guard body end as aforenoted, and with bottom 10A of ladder 2 on horizontal surface 4, the ladder leans against vertical surface 8 with pad 16 contacting said vertical surface. The resiliency of the pad prevents vertical surface 8 from becoming marred or otherwise damaged, as is the purpose of the invention.

As aforenoted, guard body ends 20 and 22 angle inwardly near their tops. Pad 16 generally follows the inwardly extending angle of the guard ends. Thus, ladder 2 can be leaned against vertical surface 8 with the assurance that a sufficient portion of pad 16 will be in contact with the surface so as to provide a desired stability when the ladder is so supported, irrespective of the angle of incline of the ladder.

With reference to FIGS. 4 and 5, each of the guard ends 20 and 22 has internally disposed, longitudinally extending ribs 30. Ribs 30 are in spaced relation along the width of the ends, each being near a corner thereof. Likewise, each of the guard body sides 17 and 18 has longitudinally extending ribs 32. Ribs 32 are in spaced relation along the width of the sides, each of the ribs being near a corner thereof. With the arrangement shown and described, each set of ribs 30 and 32 provides an internal corner for guard body 14.

As heretofore described, guard body ends 20 and 22 taper inwardly from bottom to top so that the widest portion of the guard body is at its open bottom 23. This feature of the invention, facilitates the telescoping of guard 6 over the rail end and, together with corner ribs 30 and 32, insures a snug fit with a variety of sizes of rail ends 10B.

With reference again to FIGS. 3 and 4, it will be seen that resilient pad 16 is of sufficient thickness so as to provide an appropriate "cushioning" effect as is desired when ladder 2 leans against vertical surface 8. For one reason or another it may be necessary to replace resilient pad 16. This may occur due to a loss in resiliency, or otherwise generally wearing out of the pad. This replacement is easily accomplished by simply engaging another pad 16 with a pile strip 28 affixed thereto with loop strip 24. It will be readily understood that this particular feature of the invention extends the usefulness of the invention to an extent greater than has been possible with the prior art devices. In this connection it is noted that guard 6 including ribs 30 and 32 may be molded of a suitable rigid plastic material such as polypropylene so as to necessitate little replacement if any of the guard itself. This feature of the invention further enhances its effectivity and usefulness and adds to the cost effectiveness of the device.

The invention has been described with reference to pad 16 being affixed to end 22 of guard body 14. It will be appreciated that the pad may be affixed to end 20 instead, since the guard body is symmetrical. Further, in order to still further enhance the utility and effectiveness of the invention both ends 20 and 22 may have a pad 16 affixed thereto.

With the above description of the invention in mind reference is made to the claims appended hereto for a definition of the scope of the invention.

What is claimed is:

1. A guard for the upper ends of the side rails of a ladder for providing a protective mounting against a substantially vertical supporting surface for the ladder, comprising:

a rigid body member having an open bottom, and arranged to telescope in snug fitting engagement over the upper end of a side rail;

a resilient pad; and means for removably affixing the resilient pad to the body member so that said pad engages the supporting surface for providing the protective mounting.

2. A guard as described by claim 1, wherein:

the rigid body member has a pair of longitudinally extending ends; and the means for removably affixing the resilient pad to the body member removably affixes said pad to one of the ends.

3. A guard as described by claim 2, wherein the means for removably affixing the resilient pad to the one of the ends includes:

one member of a loop member and a pile member secured to the one of the ends;

the other member of the loop member and the pile member secured to the resilient pad; and the one member and the other member being engaged for removably affixing the resilient pad to the one of the ends.

4. A guard as described by claim 1, wherein the means for removably affixing the resilient pad to the body member includes:

one member of a loop member and a pile member secured to the body member;

the other member of the loop member and the pile member secured to the resilient pad; and the one member and the other member being engaged for removably affixing the resilient pad to the body member.

5. A guard as described by claim 3, wherein:

the longitudinally extending ends of the body member angle inwardly near the tops thereof;

the resilient pad removably affixed to the one of the ends following the inwardly angle of said one end so that a sufficient portion of the pad will engage the supporting surface, irrespective of the angle of incline of the ladder against said surface.

6. A guard as described by claim 2, wherein:

the guard body member has a closed top;

the longitudinally extending ends of the body member taper inwardly from the open bottom to the closed top so that the widest portion of the body member is at the open bottom to facilitate telescoping of the body member over the upper end of the side rail.

7. A guard as described by claim 6, wherein:

the body member has a pair of sides;

each of the body member ends having a pair of internally disposed longitudinally extending ribs in spaced relation along the width of the ends;

each of the body member sides having a pair of internally disposed longitudinally extending ribs in spaced relation along the width of the sides; and all of the internally disposed longitudinally extending ribs cooperating with the inwardly taper of the body member ends for insuring a snug telescoping fit of the body member with a variety of sizes of rail ends.

* * * * *